US005233931A

United States Patent [19]

McCorkle, Jr.

[11] Patent Number: 5,233,931

[45] Date of Patent: Aug. 10, 1993

[54] TRAY FOR TRANSPORT AND DISPLAY OF MERCHANDISE

[75] Inventor: Donald E. McCorkle, Jr., Dearing, Ga.

[73] Assignee: The Edinborough Company, Dearing, Ga.

[21] Appl. No.: 855,506

[22] Filed: Mar. 20, 1992

[51] Int. Cl.[5] ..... B65D 19/44

[52] U.S. Cl. ..... 108/55.1

[58] Field of Search ..... 108/53.1, 53.3, 53.5, 108/55.1, 91, 92, 99; 211/191, 130, 2, 149

[56] References Cited

U.S. PATENT DOCUMENTS 4,199,069 4/1980 Talarico ..... 108/55.1 X

FOREIGN PATENT DOCUMENTS 759800 5/1967 Canada ..... 211/2

93547 5/1962 Denmark ..... 108/91

3810518 10/1989 Fed. Rep. of Germany ..... 108/55.1

189251 11/1922 United Kingdom ..... 211/2

*Primary Examiner*—José V. Chen

*Attorney, Agent, or Firm*—Dickinson, Wright, Moon, Van Dusen & Freeman

[57] ABSTRACT

A tray for transporting and displaying merchandise includes a bottom for supporting the merchandise, a sidewall for retaining said merchandise on the bottom, and foot members which are capable of engaging another, vertically adjacent tray. The sidewall includes a first side portion which is mounted for movement between a first position for retaining the merchandise on the bottom and a second position for permitting the merchandise to be removed. During shipment, the sidewalls are vertical to retain the merchandise. After the tray has reached its destination, the sidewalls are lowered to display the merchandise and permit it to be removed from the tray by the customer.

9 Claims, 2 Drawing Sheets

TRAY FOR TRANSPORT AND DISPLAY OF MERCHANDISE

TECHNICAL FIELD

This invention relates to the art of trays which are used for the transport of merchandise. The invention finds particular utility when used for transport and display of plants.

BACKGROUND

It is known to provide a skid for the transport of articles. The articles are typically placed on the skid, and the skid is moved about with the articles on it by a variety of means, such as by a known fork lift. It is also known to place articles in a tray or box and to move the articles by transporting the box.

It is also known to display plants for sale, such as balled plants, container plants, or the like, on a number of vertically arranged, horizontal shelves. The plants in this situation must be placed on the shelves individually, even though they may have been transported from the nursery to the retail outlet on skids, or the like.

Known arrangements for supporting plants, or the like are shown in U.S. Pat. Nos. 3,118,249 (Bard et al.), 4,045,911 (Ware), 4,191,112 (Maldonado), and 4,276,720 (Lyon).

SUMMARY OF THE INVENTION

The prior art techniques for transporting and displaying a variety of items is inefficient, and hence, costly. For example, the transport and display of balled plants and container plants is typically accomplished by hand loading the plants onto skids at the nursery and transporting the skids to the retail outlet by truck. The plants are then transferred by hand from the skids to display shelves.

In accordance with the invention, a tray is provided which permits both transport and display of the plants. The tray is preferably one of a group of similar trays capable of being stacked during both transport and display, and the trays are easily loaded or unloaded by a machine, preferably a forklift.

In the preferred embodiment, the tray includes a generally flat bottom surface for supporting the plants. A sidewall extends around the bottom for retaining the plants in the tray during transport locally within the nursery by a wagon and forklift and over the road by truck. When the tray is at its final destination, and the plants are to be displayed for sale, portions of the sidewall are pivoted to horizontal positions extending outward from the bottom surface.

The horizontal sidewall portions then become extensions of the bottom. This allows the plants to be spread out and easily selected and picked up by the buyer. Moreover, a placard may be secured to the pivotal sidewall such that it is protected during shipment and visible during display.

When the trays are stacked, upper trays are supported by lower trays and the trays are separated by poles of selected lengths. The poles are removable and may be chosen from poles of different lengths, which allows the user to select a desired vertical distance between adjacent trays. The ability to vary the distance between adjacent trays allows a single tray to be used for shorter plants or for taller plants, the taller plants being accommodated in a stack of trays by providing longer poles to space the tray immediately above the tray having the tall plants by an adequate distance. The tops of the removable poles in a lower tray are received in tapered elements of an upper tray which quickly align with the poles and facilitate assembly of the stack of trays.

DETAILED DESCRIPTION OF THE DRAWINGS

Figure 1:
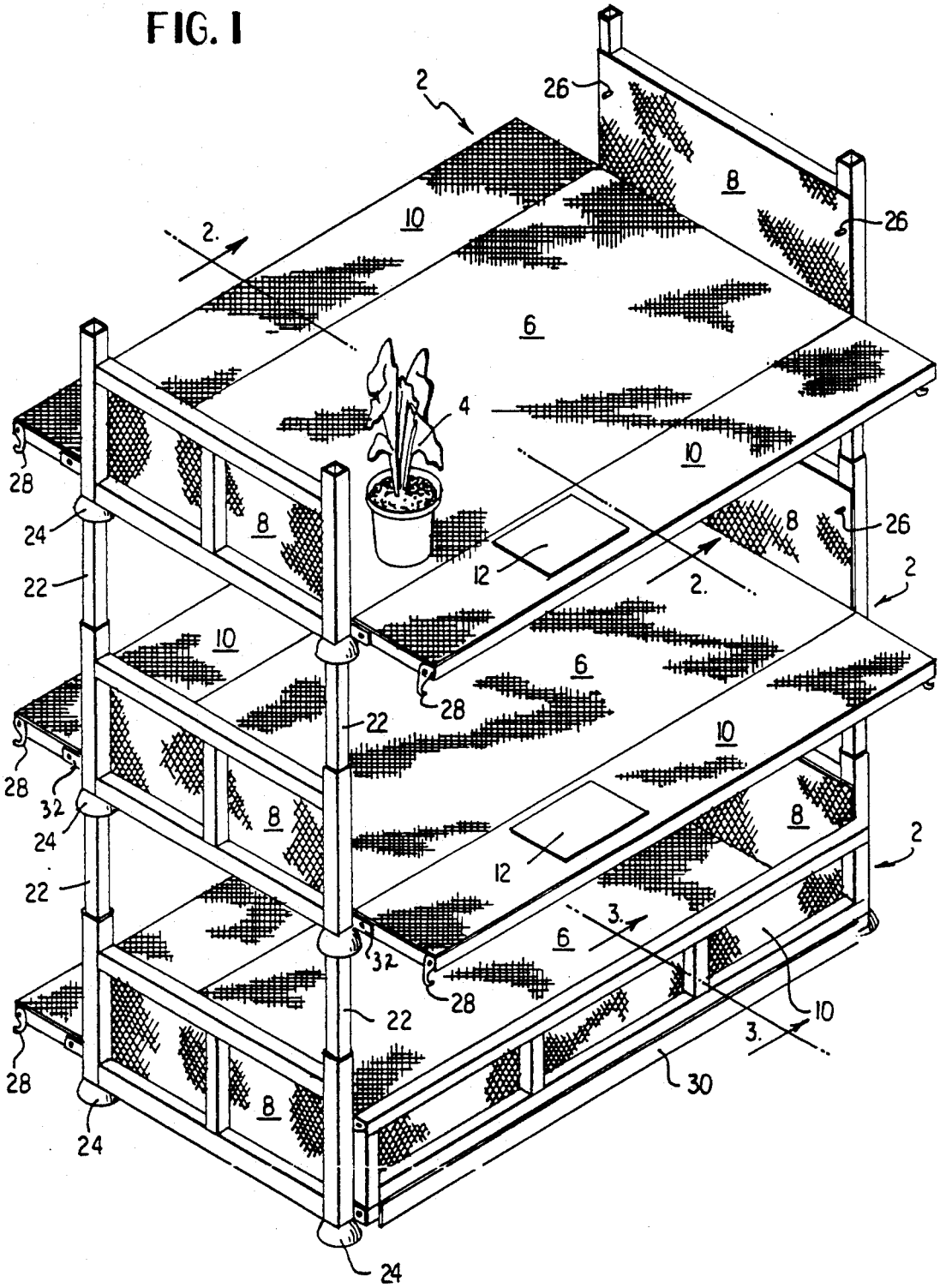
FIG. 1 is a perspective of a stack of three trays in accordance with the invention.

With reference to FIG. 1, a stack of identical trays 2 is shown arranged for display of merchandise, such as container plants 4. Each of the trays includes a bottom surface 6 and a sidewall 8. Portions 10 of the sidewall are mounted for pivotal movement between two orientations. In the first orientation, shown on the right side of the bottom tray in FIG. 1, the sidewall portions 10 are vertical and cooperate with the other parts of the sidewall to retain the plants 4, or other merchandise, on the bottom 6. In the second orientation shown in FIG. 1, the sidewall portions 10 are horizontal and extend outward from the bottom surface 6.

When the sidewall portions are placed in horizontal orientations, the area of the bottom is increased significantly, which allows the plants to be spread out for attractive display at a retail outlet and easily removed for purchase by a customer. In addition, a placard 12, which has been placed on the sidewall 10 by the nursery, becomes visible to the customer. This placard may contain such information as the type of plant and its price and is protected during shipment because it faces the interior of the tray when the sidewall portion 10 is in the vertical orientation.

Figure 2:
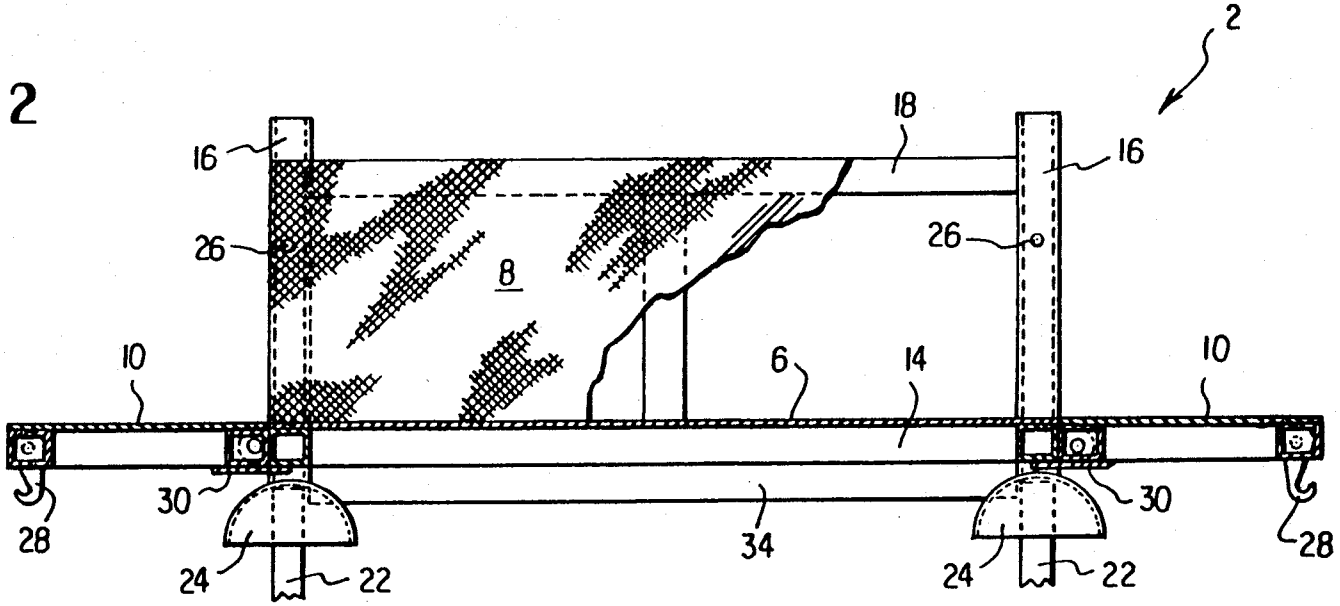
FIG. 2 is a cross section of a single one of the trays taken along line 2—2 of FIG. 1.
Figure 3:
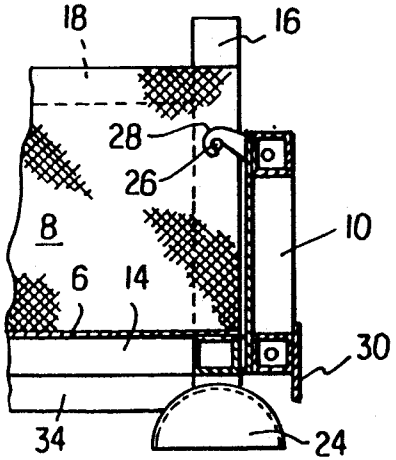
FIG. 3 is a partial cross section of one of the trays taken along line 3—3 of FIG. 1.

The preferred construction of the trays is illustrated in more detail in FIGS. 2 and 3.

Referring to FIG. 2, the bottom of a tray for use with such items as container plants preferably comprises a rectangular frame of tubing 14 which is covered with steel mesh. Similarly, the fixed portions of the sidewalls comprise rectangular frames of vertical tubing elements 16 and horizontal elements 18 covered with steel mesh, and the pivotal sidewall portions comprise rectangular frames of tubing 20 covered with steel mesh.

The vertical tubing elements 16 are capable of receiving poles 22 for separating one tray from another when in the stacked orientation shown in FIG. 1. The lower ends of the poles 22 may be rounded or narrowed slightly to fit inside the vertical elements 16, or other removable connections may be used. Poles 22 of various lengths are preferably supplied to allow the nursery to select a length for accommodating plants of various heights. Thus, if a tray 2 has tall plants, poles 22 having lengths adequate to space the tray above that one by an adequate distance would be chosen. Conversely, trays with shorter plants will require shorter poles to support the upper tray.

Each of the trays includes a foot member 24 at each of the corners which serve dual purposes. The foot members have flat bottoms for engaging a floor whereby any of the trays can be placed on a floor. The foot members are also hollow, for receiving the upper ends of poles 22, and taper upward, for easily aligning the poles and facilitating assembly. In the preferred embodiment, the foot members are hemispherical, but they may have other shapes.

FIGS. 3 and 4 illustrate preferred mechanisms for holding the sidewall portions 10 in one of the two orientations. A pin 26 extends outward from the vertical tubing 16 and engages a latch 28 when the sidewall 10 is in a vertical orientation to hold the sidewall in that orientation. The sidewall 10 is released for rotation to the horizontal orientation by rotating the latch 28 out of engagement with the pin 26.

A stop plate 30 is affixed to the bottom part of the sidewall 10 and engages the bottom of the tray when the sidewall 10 is horizontal to prevent further rotation of the sidewall. The stop plate preferably extends a substantial distance along the sidewall 10 to provide strength and may be continuous or is discrete sections. Other mechanisms to support the sidewall in the lowered position may be used.

Hinge plates 32 are provided at the ends of the trays for engaging pins attached to the sidewalls 10 to provide a pivotal connection. Other arrangements, including such variations as attaching the hinge plate to the sidewall, are possible.

The preferred method of carrying the trays about the nursery is by a farm wagon specifically designed for the trays. The trays are lifted from the wagon by a known forklift for carrying to a truck or lifted from the truck by the forklift and carried to another wagon or to a display location. To facilitate this, two parallel guides 34 for engaging the outer sides of the tines of a forklift are secured below the bottom 6. These guides are spaced by the distance between the outer edges of the fork lift tines and prevent side-to-side movement of the tray when it is on the forklift.

Modifications within the scope of the appended claims will be apparent to those of skill in the art.

I claim:

1. Apparatus for transporting and displaying merchandise comprising a tray having a bottom surface for supporting said merchandise and sidewall means for retaining said merchandise on said bottom surface and for displaying said merchandise, wherein said sidewall means comprises a first side portion mounted to said tray for movement between a first, upstanding position for retaining said merchandise on said bottom surface and a second, outwardly extended position where a surface of said first side portion is generally aligned with said bottom surface in the direction of said bottom surface for permitting said merchandise to be moved easily between said bottom surface and said surface of said first side portion for display, and further comprising means for retaining said first side portion in each of said first and second positions to support the weight of said merchandise on said first side portion when said first side portion is in said second position, and means for engaging another, vertically adjacent tray.

2. Apparatus according to claim 1 wherein said sidewall means further comprises a second side portion mounted for movement between a first position for retaining said merchandise on said bottom surface and a second position for permitting said merchandise to be moved easily between said bottom surface and said surface of said second side portion for display, and further comprising means for retaining said second side portion in each of said first and second positions of said second side portion and having strength adequate to support the weight of said merchandise on said second side portion when said first side portion is in said second position.

3. Apparatus according to claim 2 wherein said first and second side portions are substantially horizontal and horizontally aligned with said bottom surface when in said second positions.

4. Apparatus according to claim 3 wherein said means for engaging another, vertically adjacent tray comprises a plurality of elements on the bottom of said tray for engaging a planar surface and for receiving a vertical post.

5. Apparatus according to claim 4 further comprising means for engaging a fork lift for permitting said tray to be carried by said fork lift.

6. Apparatus according to claim 4 wherein said means for engaging comprises at least three foot members mounted below said bottom surface of said tray, each of said foot members being hollow and having an upwardly tapered interior for receiving said vertical post.

7. Apparatus according to claim 6 wherein each of said foot members has a flat bottom for engaging said planar surface.

8. A method for transporting and displaying merchandise comprising placing said merchandise on a tray having a bottom surface for supporting said merchandise, sidewall means for retaining said merchandise on said bottom surface, and means for engaging another, vertically adjacent said tray, wherein said sidewall means comprises a side portion mounted to said tray for movement between a first upstanding position for retaining said merchandise on said bottom surface and a second outwardly extended position where a surface of said first side portion is generally aligned with said bottom surface in a direction of said bottom surface for permitting said merchandise to be moved easily between said bottom surface and a surface of said side portion for display and to support the weight of said merchandise on said first side portion when said first side portion is in said second position, transporting said tray having said merchandise thereon with said first side portion in said first position, moving said side portion to said second position, and moving said merchandise from said bottom surface to said surface of said side portion to display said merchandise.

9. A method according to claim 8 wherein said first side portion is substantially vertical when in said first position and substantially horizontal when in said second position.

* * * * *